US007015866B1

(12) United States Patent
Lopez

(10) Patent No.: US 7,015,866 B1
(45) Date of Patent: Mar. 21, 2006

(54) FLUSH-MOUNTED AIR VEHICLE ARRAY ANTENNA SYSTEMS FOR SATELLITE COMMUNICATION

(75) Inventor: Alfred R. Lopez, Commack, NY (US)

(73) Assignee: BAE SYSTEMS Information and Electronic Systems Integration Inc., Greenlawn, NY (US)

( * ) Notice: Subject to any disclaimer, the term of this patent is extended or adjusted under 35 U.S.C. 154(b) by 0 days.

(21) Appl. No.: 10/810,251

(22) Filed: Mar. 26, 2004

(51) Int. Cl.
*H01Q 3/00* (2006.01)

(52) U.S. Cl. ..... 343/757; 343/765; 343/770

(58) Field of Classification Search ..... 343/757, 343/765, 766, 767, 770, 771, 878
See application file for complete search history.

(56) References Cited

U.S. PATENT DOCUMENTS 5,227,806 A * 7/1993 Eguchi ..... 343/765
5,359,337 A * 10/1994 Eguchi ..... 343/765
5,420,598 A 5/1995 Uematsu et al. ..... 343/765
5,579,019 A * 11/1996 Uematsu et al. ..... 343/771
6,259,415 B1 * 7/2001 Kumpfbeck et al. ..... 343/765
6,538,612 B1 * 3/2003 King ..... 343/757

* cited by examiner

*Primary Examiner*—Tan Ho
(74) *Attorney, Agent, or Firm*—Kenneth P. Robinson

(57) ABSTRACT

An antenna system to enable satellite communication with a moving vehicle, such as an aircraft, includes an array formed by a group of subarrays. The array is positioned within a cavity and arranged to be mechanically tilted about a horizontal axis-of-rotation to provide elevation scanning of an antenna beam pattern (e.g., 20 to 90 degree elevation scan). The array, with the cavity, is mechanically rotated to provide azimuth scanning of the beam pattern (e.g., 360 degree azimuth scan). Each subarray may be a square flat-plate array having slot-type radiating elements (e.g., simple or crossed-slot elements). Equal excitation of the subarrays for receive or transmit may be provided by a feed configuration at the back of the array.

20 Claims, 5 Drawing Sheets

FLUSH-MOUNTED AIR VEHICLE ARRAY ANTENNA SYSTEMS FOR SATELLITE COMMUNICATION

RELATED APPLICATIONS (Not Applicable)

FEDERALLY SPONSORED RESEARCH (Not Applicable)

BACKGROUND OF THE INVENTION

This invention relates to array antennas and, more particularly, to such antennas usable to provide communication with an air vehicle via satellite.

A variety of forms of antennas have been proposed for point-to-point communication via satellite. In such applications, a radio frequency signal is transmitted from a first antenna providing a beam directed at a satellite, the satellite acts as a repeater re-transmitting received signals, and a second antenna directed at the satellite receives a signal replicating the signal as transmitted from the first antenna. The sequence may be reversed to enable reception at the first antenna of a signal representative of a signal transmitted from the second antenna, to provide two-way communication.

In a form of satellite communication system (referred to generally as a SATCOM system), a series of satellites may be maintained in fixed (GEO) synchronous orbit above the equator, with the satellites in spaced positions along an arc within an equatorial plane. The MILSTAR system is an example of such a system. MILSTAR is a military satellite communication system. Its GEO synchronous satellites transmit at 20 GHz and receive at 45 GHz.

Provision of antenna systems suitable for mounting on air vehicles and other moving vehicles for communication via such satellites is subject to a number of constraints. The antenna is desirably of relatively small size and reasonable cost. Thus, while a two-dimensional fully electronically scannable phased-array type antenna might be considered, cost would generally be prohibitive and low angle (low elevation) scanning would typically be limited. For present purposes, the term "air vehicle" includes traditional aircraft, as well as drones, military and other devices having a guided trajectory during powered or unpowered flight and other vehicles in moving or stationary airborne configurations. For many such applications, antenna overall size, exposed size and profile are desirably minimized in view of drag and other considerations.

Sidelobe and azimuth beamwidth characteristics are particularly important in order to enable discrimination between signal transmission/reception characteristics (i.e., antenna patterns) of adjacent satellites to avoid interference during signal reception and transmission from a vehicle. Known forms of prior antennas have generally not been capable of meeting all constraints relevant to such applications.

Objects of the present invention are, therefore, to provide new or improved antenna systems suitable for communication via satellite and antenna systems providing one or more of the following capabilities or characteristics:

- flush-mountable for air vehicle applications;
- low-complexity mechanical scan in elevation and azimuth;
- 20° to 90° elevation and 360° azimuth coverage;
- satellite tracking capability from a moving air vehicle;

- thin array construction using flat-plate subarrays;
- uniform excitation of subarrays;
- cost effective design; and
- compact size.

SUMMARY OF THE INVENTION

In accordance with the invention, a flush-mount antenna system to enable communication with a moving vehicle via a satellite includes a cavity having a rectangular upper perimeter with four sides and having a depth normal to the perimeter. An array comprising a plurality of subarrays of rectangular form is positioned in a two-dimensional rectangular arrangement having length and width edges and configured to provide a beam pattern. Each such subarray includes at least one waveguide having slot-type radiating elements, which may be of crossed-slot configuration. The array is positioned within the cavity and, in order to scan the beam pattern in elevation, is arranged for rotation about an axis-of-rotation adjacent to an edge of the array and aligned with a side of the cavity perimeter. An elevation scan actuator is provided to mechanically tilt the array about such axis-of-rotation without removing the array from the cavity. The antenna system also includes a signal port and a feed configuration to couple signals between the signal port and each subarray. An azimuth scan assembly may be arranged to mechanically rotate the cavity with the included array to provide scanning in azimuth.

For a better understanding of the invention, together with other and further objects, reference is made to the accompanying drawings and the scope of the invention will be pointed out in the accompanying claims.

DESCRIPTION OF THE INVENTION

Figure 1:
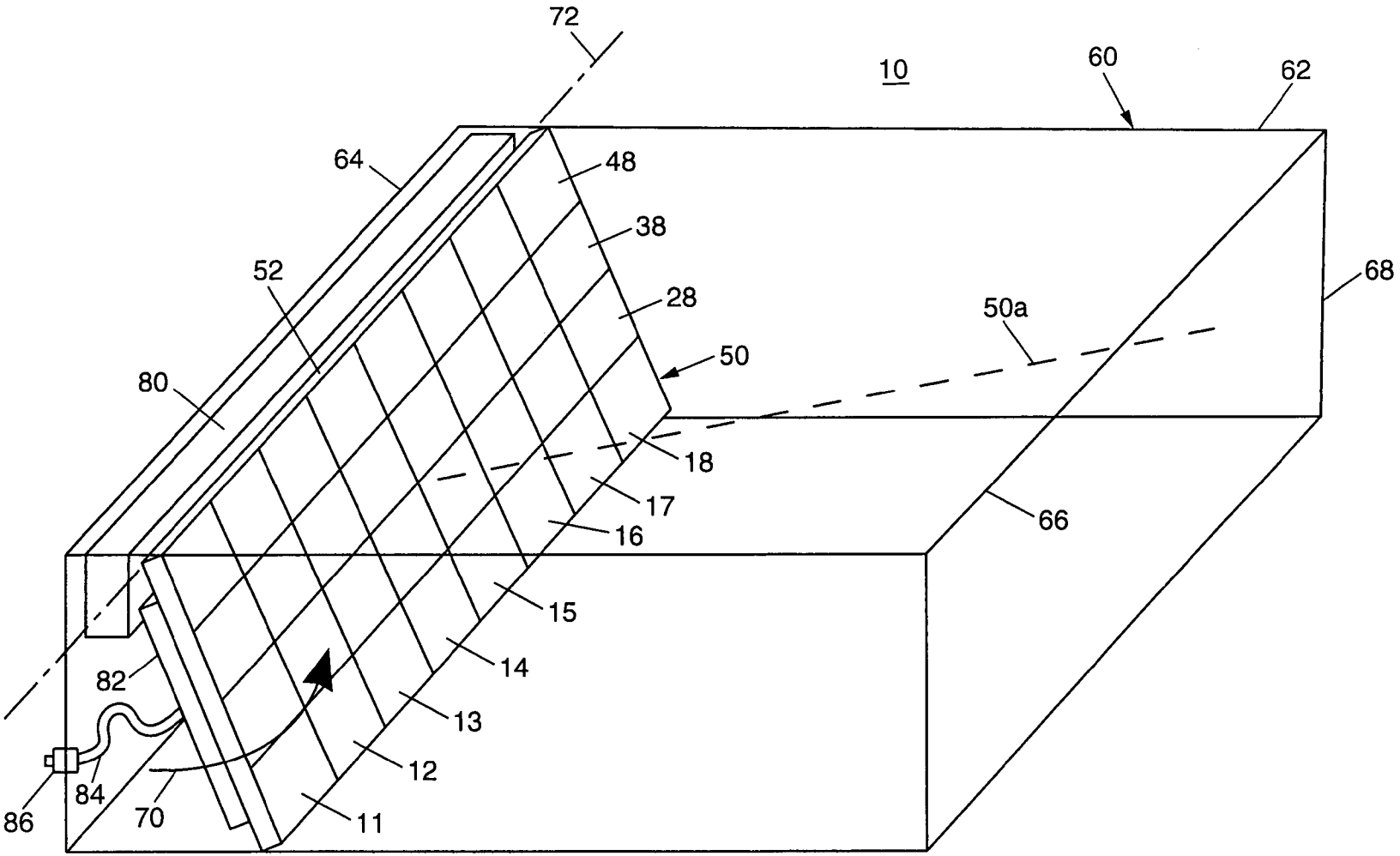
FIG. 1 is a simplified perspective view of a flush mount antenna system utilizing the invention.

FIG. 1 is a simplified perspective view of a flush mount antenna system 10 configured to enable communication with an air vehicle (e.g., an aircraft) or other moving vehicle via a satellite. As shown in transparent outline form for purposes of illustration, the antenna system includes a cavity 60 which, in this example, includes a nominally rectangular upper perimeter 62 with four sides and having a depth normal to the perimeter. As shown, the perimeter 62 includes width sides 64 and 66 at opposite ends and a depth 68. Cavity 60 represents an open volume which may be built into the outer surface of an aircraft with the upper perimeter 62 flush with such outer surface. For present purposes, "flush" is defined as being positioned so the upper perimeter 62 does not extend above such outer surface by more than one-half of the depth 16 and to minimize drag effects may preferably be at the same level as the outer surface. Cavity 62 may be defined by structural sides and bottom (e.g., sheet metal) or may be a portion of a larger open volume as will be further described. In the drawings the dimensions are not necessarily accurate and may be distorted for purposes of clarity of presentation.

Antenna system 10 includes an array 50 comprising a plurality of subarrays in a two-dimensional arrangement. As shown, subarrays 11, 12, 13, 14, 15, 16, 17, 18 each of rectangular form (i.e., square) are positioned in a first column with three additional columns of eight subarrays each shown with respective right-end subarrays labeled as subarrays 28, 38, 48. In this example, the subarrays are positioned in a rectangular arrangement having length and width edges, including a length edge 52. As will be described with reference to FIG. 4, each subarray (e.g., subarrays 11–18) includes at least one waveguide having slot-type radiating elements.

As shown, the array 50 is positioned within cavity 60 at an angled orientation. Array 50 is configured to provide a fan-type antenna beam pattern and the angled orientation is arranged so that with the array in its lowest operating position as shown, the beam pattern will be projected above side 66 of the upper perimeter, so as for example to cause the lower half-power level of the beam pattern (e.g., as represented by a line through the 3 dB point on the lower side of the beam indicated by dashed line 50*a*) to be at or above side 66 of the upper perimeter 62. In a typical application, for a particular form of array 50 the length dimension of cavity 60 perpendicular to perimeter side 66 may be determined so that with array 50 in its lowest operational position (as represented in FIG. 1) the centerline of the beam pattern (i.e., boresight axis of the array) is at an angle of 20 degrees above the horizon, when the upper perimeter 62 has a horizontal alignment. With an understanding of the invention, skilled persons will be enabled to determine geometric and other considerations appropriate to particular applications.

As represented by arrow 70 in FIG. 1, the array 50 positioned within cavity 60 is arranged for rotation about an axis-of-rotation 72 which is adjacent to edge 52 of array 50 and aligned with side 64 of upper perimeter 62 of cavity 60. During level flight of an air vehicle, axis-of-rotation 72 will typically have a horizontal alignment. At 80 is represented in block form an elevation scan actuator arranged to mechanically tilt array 50 about the axis-of-rotation 72 without removing the array from cavity 60. Elevation scan actuator 80 may be any form of electromechanical or other device or arrangement suitable in a particular embodiment to enable and control rotation of array 50 (e.g., a stepping motor control arrangement). With this configuration, tilting of array 50 about axis-of-rotation 72 can be arranged to provide elevation scanning or pointing of the antenna beam over a range of 20 to 90 degrees in elevation. This elevation scan capability, together with 360 degree mechanical azimuth rotation, can provide a full satellite tracking capability from an aircraft or other air vehicle, as will be further described.

As illustrated in FIG. 1, antenna system 10 further includes a feed configuration 82 shown at the back of array 50 and arranged to couple signals to each subarray of array 50 for transmission, from each such subarray for signal reception, or both. Feed configuration 82 may include a signal divider/combiner feed network or other suitable arrangement using known techniques. In FIG. 1, a signal port 86 and cable 84 coupling to feed configuration 82 are shown in simplified form and may comprise any forms of cable and coaxial or other connector arrangements employing multiple conductor or other means suitable in particular applications, as determined by skilled persons.

Figure 3:
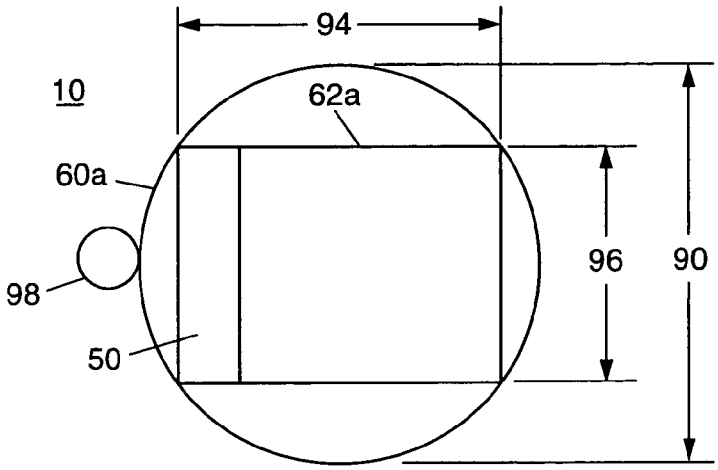
FIG. 2 and FIG. 3 are simplified side and plan views showing aspects of implementation of the FIG. 1 antenna system.
Figure 2:
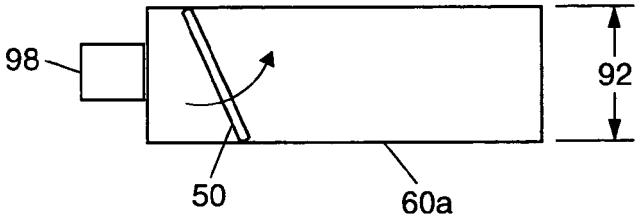

Referring now to FIGS. 2 and 3 there are shown respective simplified side and plan views of an embodiment of the FIG. 1 antenna system. In this embodiment, the cavity 60*a* has the form of a drum-shaped circular cylindrical structure (e.g., of sheet metal or other suitable construction) having a diameter 90 and a depth 92. The upper surface of cavity 60*a* includes a rectangular cutout defining an upper perimeter 62*a*. Array 50 is represented within cavity 60*a* at an angled orientation as in FIG. 1. As shown in FIG. 3, upper perimeter 62*a* has a length 94 and a width 96. Other details of the antenna system of FIGS. 2 and 3 may be as shown in FIG. 1 or as determined by a skilled person for a particular implementation.

With the circular form shown in FIG. 3, the cavity 60*a* may be arranged for rotatable installation into an upper surface of an aircraft fuselage, for example, with the upper surface of the drum configuration nominally flush with the outer surface of the aircraft. With suitable structural arrangements to support cavity 60*a* in such position and to permit its rotation, an azimuth scan assembly may be provided to mechanically rotate the antenna system in azimuth and thereby scan the antenna beam pattern in azimuth. In FIGS. 2 and 3, the azimuth scan assembly is represented in block form at 98 and may be any form of electromechanical or other device or arrangement suitable in a particular embodiment to enable and control rotation of cavity 60*a* (e.g., a small electric motor geared to the cavity). With this arrangement the antenna beam pattern can be scanned in azimuth over a 360 degree azimuth range.

Figure 4:
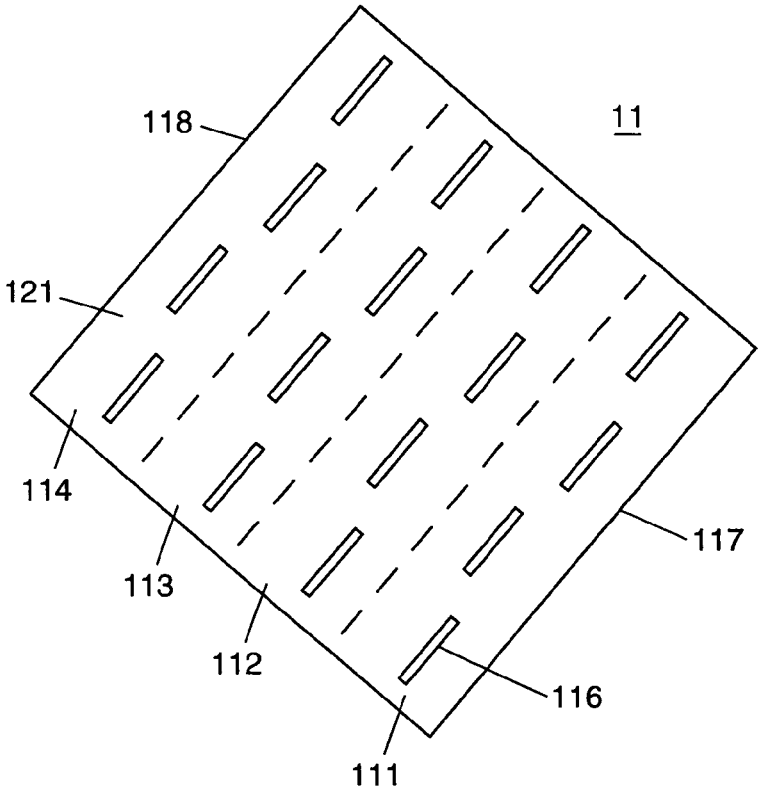
FIG. 4 is a front view of a subarray with slot-type radiating elements usable in the FIG. 1 antenna system.

As described above, array 50 as shown in FIG. 1 includes a plurality of subarrays arranged in four rows, of which the first row includes eight subarrays 11 through 18. FIG. 4 is an enlarged front view of subarray 11, which is representative of each of the 32 subarrays included in the two-dimensional array 50 of FIG. 1. Subarray 11 is of flat-plate construction and includes at least one slotted waveguide extending nominally parallel to a side of the individual subarray. As illustrated, subarray 11 includes four slotted waveguides 111,112, 113, 114. While not visible on the face of the subarray 11, separations between the waveguides are represented by dashed lines in FIG. 4. In this embodiment, each of the side-by-side waveguides 111–114 includes a series of four longitudinal slots, of which slot 116 is representative. Thus, subarray 11 includes four slotted waveguides, each extending parallel to sides 117 and 118 of the subarray.

Figure 5:
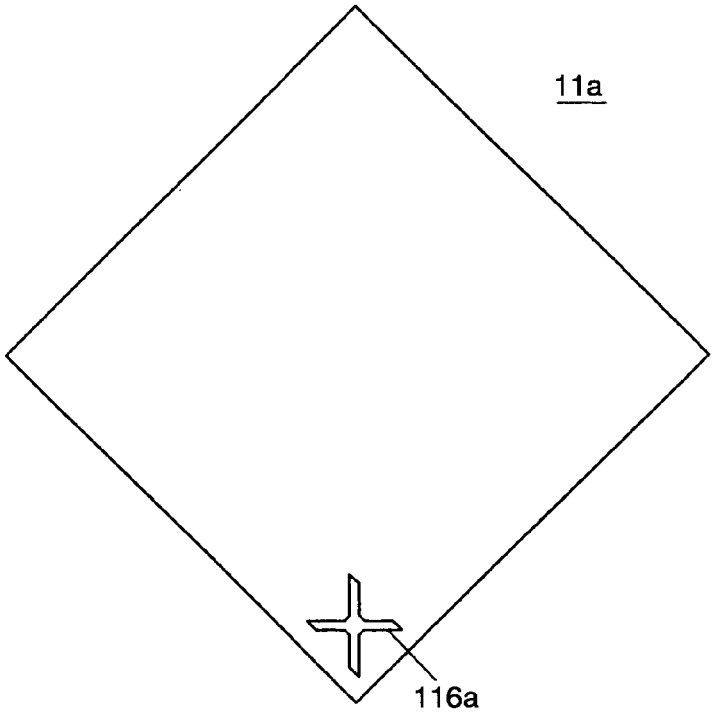
FIG. 5 shows a form of crossed-slot or x-slot radiating element usable in substitution for the slot-type radiating elements of FIG. 4.

Construction elements of a flat-plate subarray (e.g., representative subarray 11) are described with reference to FIGS. 3–7 of the present inventor's pending application Ser. No. 10/680,485 filed Oct. 7, 20003 (herein sometimes termed the '485 application). The content of the '485 application, having a common assignee with the present invention, is hereby incorporated by reference. As an alternative to the configuration of slots shown in FIG. 4, the slots may be replaced by a configuration of crossed slots or "x-slots". FIG. 5 is an enlarged front view of subarray 11 in an alternative form designated 11 a including an x-slot element 116*a*. The x-slot 116*a* is representative of an arrangement of slots similar to the full complement of slots shown for subarray 11 in FIG. 4. By provision of x-slot radiating elements rather than the slot elements of FIG. 4, the subarrays and the complete array 50 are effective to provide operation with circular polarization of signals. Transmission or reception, or both, of circularly polarized signals directly by the array avoids the need to provide a separate polarizer configuration or plate overlying the face of the array to enable communication via satellites operating with circular polarization.

Figure 6:
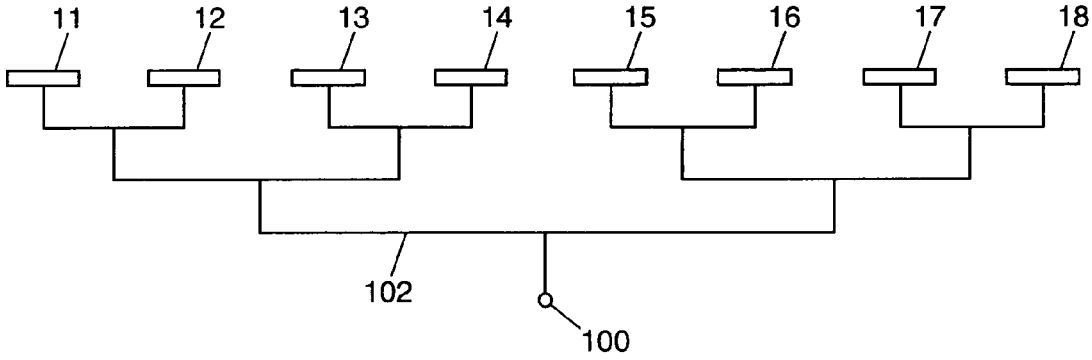
FIG. 6 shows a representative portion of a feed configuration usable in the FIG. 1 antenna system.

In the FIG. 1 embodiment, each of the 32 subarrays is arranged for uniform excitation. FIG. 6 illustrates a partial circuit for a binary feed configuration to provide uniform excitation of subarrays which may in turn include internal feed configurations for excitation of individual slots, a detailed example of which is provided in the '485 application. In FIG. 6, a signal port 100 is coupled to feed configuration 102, which is arranged to couple signals between the signal port 100 and each of the subarrays 11–18 of array 50 of FIG. 1. Subarrays 11–18 are represented in side view in spaced relation for purposes of illustration. To follow through on this illustration, the eight subarrays of each of the three additional columns (i.e., including subarrays 28, 38, 48) would each be coupled to a replication of the feed configuration 102 of FIG. 6 and all four of the resulting 102 type of feed configurations would in turn be fed by binary interconnections (i.e., column-to-column) to enable the four 102 type feeds to be uniformly excited via a single signal port (e.g., port 86 of FIG. 1). It will be appreciated that reciprocal operation is applicable, so that for transmission a signal supplied to port 86 would uniformly excite all 32 subarrays in this example, whereas for reception signals received via each subarray would be combined with equal weighting by the composite feed configuration and made available at port 86 for further processing. For particular embodiments, skilled persons having an understanding of the invention will be enabled to implement different forms of feed configurations, which may provide non-uniform excitation for example, as suitable to meet particular objectives.

While the same antenna system can, in general, be used for signal transmission as well as signal reception, for transmission of signals to a satellite a SATCOM system may utilize a frequency range of 43.5–45.5 GHz, while utilizing a range of 20.2–21.2 GHz for reception of satellite signals. To this end, the antenna system of FIGS. 2 and 3 may have dimensions approximately as follows to provide a SATCOM receive antenna system: diameter 90 of 21.9 inches, depth 92 of 5.8 inches, cavity length 94 of 18.2 inches and cavity width 96 of 12.3 inches. For this purpose, the array 50 of FIG. 1 may include 32 subarrays in a two-dimensional rectangular configuration, as shown, having an approximate length of 12.3 inches and width of 6.2 inches. Because of the higher frequencies involved, for a corresponding SATCOM transmit antenna system the array 50 of FIG. 1 may include 32 subarrays in the configuration as shown having an approximate length of 11.0 inches and width of 5.5 inches, with the dimensions of FIGS. 2 and 3 correspondingly reduced to accommodate the smaller transmit array.

With the construction of the FIG. 1 antenna system as shown and described, computed performance characteristics for reception include antenna gain of 33.0 dBi, azimuth beamwidth of 2.4 degrees, with 360 degree scan, and elevation beamwidth of 4.6 degrees, with 20 to 90 degree scan. Characteristics for transmit include antenna gain of 38.0 dBi, azimuth beamwidth of 1.3 degrees with 360 degree scan and elevation beamwidth of 2.5 degrees with 20 to 90 degrees scan. With nominally equal excitation of all 32 radiating elements, the array 50 as described is effective to project a fan-type beam pattern normal to the face of the array. The term "nominally" is defined as within plus or minus twenty percent of a referenced size, relationship or other characteristic. To provide suitable performance for receive, feed configuration 82 may include a low noise amplifier connected to each subarray and, for transmit, may include a power amplifier connected to each subarray. With an understanding of the invention, skilled persons will be enabled to apply known antenna design techniques in addressing requirements of particular implementations. For example in the receive mode, the number and size of individual subarrays can be selected such that the antenna temperature characteristic is reduced and the overall array size is small enough for a flush mounted configuration as illustrated in FIG. 1.

With the antenna beam projected normal to the face of the array as described, mechanical provision for beam steering in azimuth and elevation is provided as appropriate for practical implementation of an airborne antenna system for satellite communication. Basically, to accomplish such beam steering or pointing to aim the beam and track the position of a satellite in the presence of vehicle motion, the array is mechanically rotated (e.g., over a 360 degree range in azimuth) by a suitable azimuth scan assembly, to provide steering in azimuth, and mechanically tilted (e.g., over a 20 to 90 degree range in elevation) by a suitable elevation scan actuator to provide steering in elevation. With an understanding of the invention, skilled persons using available techniques will be enabled to provide a variety of mechanical beam steering implementations as appropriate for particular applications. In addition to the arrangements discussed above, mechanical rotation and tilt arrangements for antenna beam azimuth and elevation steering in the context of reception of satellite-transmitted television signals are disclosed in U.S. Pat. Nos. 6,259,415, 5,579,019 and 5,420,598. The content of patent U.S. Pat. No. 6,259,415, having a common assignee with the present invention, is hereby incorporated herein by reference.

Figure 7:
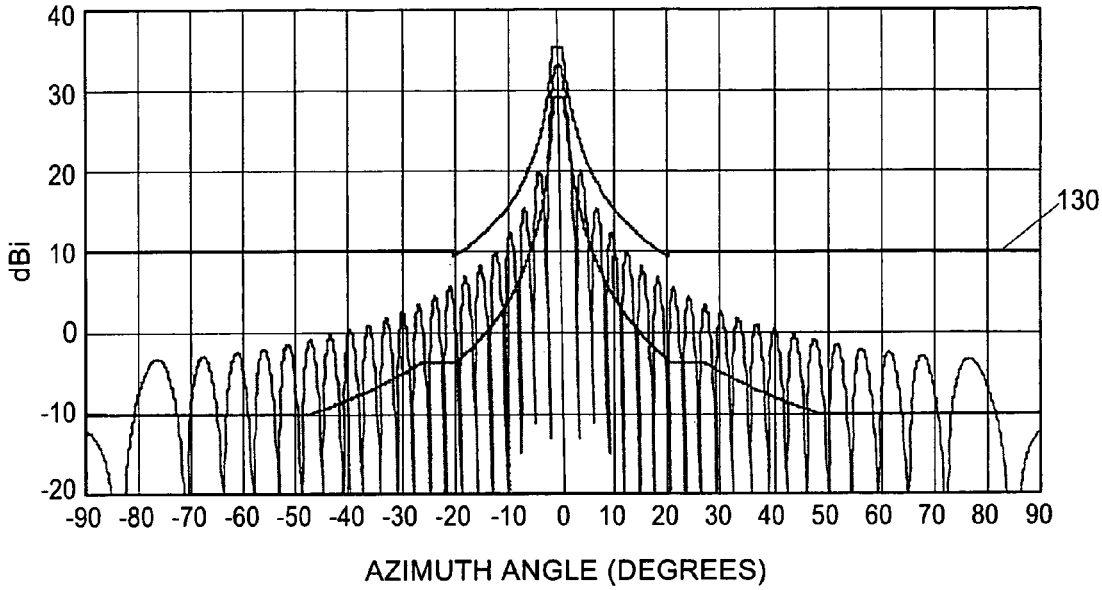
FIG. 7 and FIG. 8 are respective computed azimuth and elevation antenna patterns for a FIG. 1 antenna system employed for signal reception.
Figure 8:
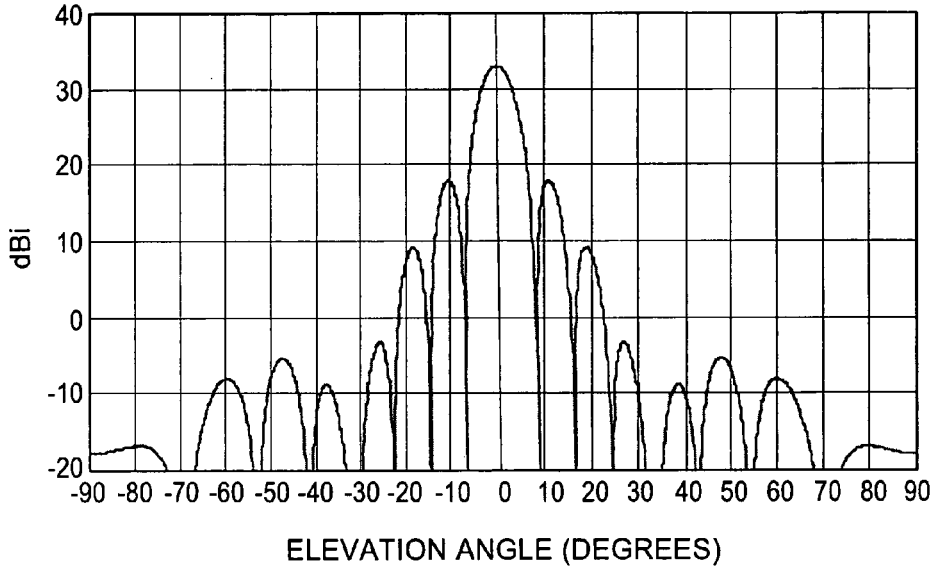

For a receive antenna system of the type shown in FIG. 1 employing an array having 32 x-slot subarrays, with approximate overall array dimensions of 6.2 inches by 12.3 inches as discussed above, computed receive antenna patterns are shown in FIGS. 7 and 8. FIG. 7 is an azimuth antenna pattern for operation at a SATCOM receive frequency of 20.2 GHz. Profile line 130 represents a military specification regarding a maximum sidelobe radiation level standard intended to limit interference relative to operation of adjacent or other satellites. The INTELSAT Earth Station Standard (IESS-601) is somewhat more stringent in providing that sidelobes within plus or minus 20 degrees of antenna boresight be suppressed by an additional 3 dB. FIG. 8 is a corresponding elevation antenna pattern for the 20.2 GHz receive frequency.

Figure 9:
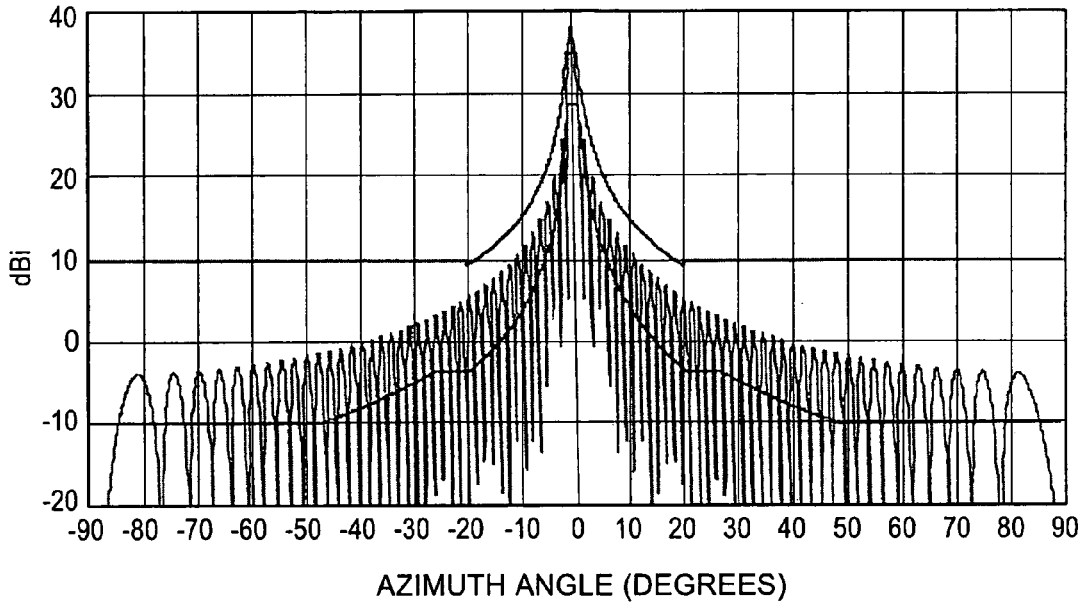
FIG. 9 and FIG. 10 are respective computed azimuth and elevation antenna patterns for a FIG. 1 antenna system employed for signal transmission.
Figure 10:
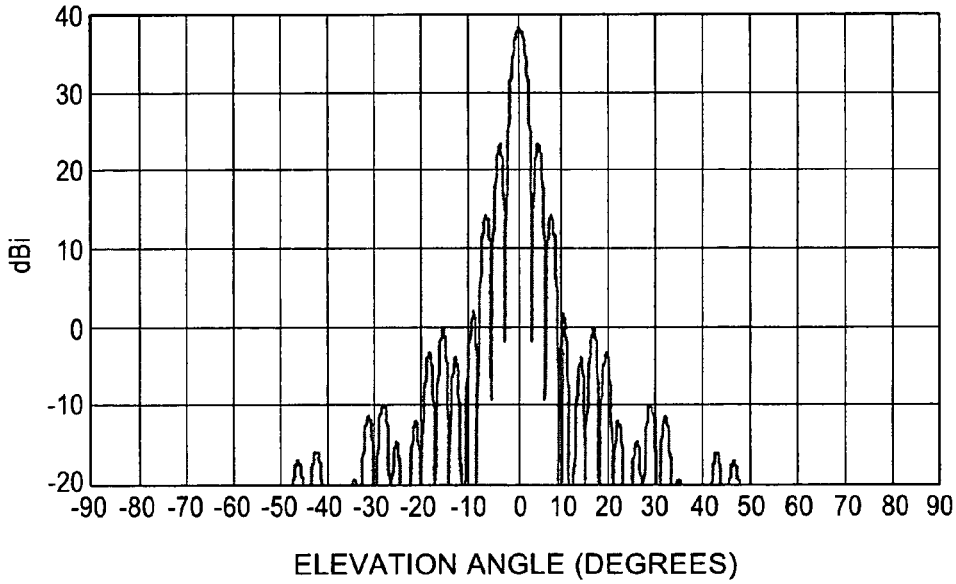

FIGS. 9 and 10 are corresponding azimuth and elevation transmit antenna patterns computed for a transmit antenna system of the type shown in FIG. 1 employing an array with approximate overall dimensions of 5.5 inches by 11.0 inches as discussed above. FIGS. 9 and 10 are respective azimuth and elevation patterns for operation at a transmit frequency of 43.5 GHz.

While there have been described the currently preferred embodiments of the invention, those skilled in the art will recognize that other and further modifications may be made without departing from the invention and it is intended to claim all modifications and variations as fall within the scope of the invention.

The invention claimed is:

1. A flush-mount antenna system, to enable communication with a moving vehicle via a satellite, comprising:

a cavity having a rectangular upper perimeter with four sides and having a depth normal to said perimeter;

an array comprising a plurality of subarrays of rectangular form positioned in a rectangular arrangement having length and width edges, each such subarray including at least one waveguide having slot-type radiating elements;

said array positioned within said cavity and arranged for rotation about an axis-of-rotation adjacent to an edge of the array and aligned with a side of the upper perimeter;

an elevation scan actuator to mechanically tilt said array about said axis-of-rotation without removing the array from said cavity;

a signal port; and a feed configuration to couple signals between the signal port and each subarray.

2. A flush-mount antenna system as in claim 1, additionally comprising:

an azimuth scan assembly to mechanically rotate said array to provide scanning in azimuth.

3. A flush-mount antenna system as in claim 2, wherein the azimuth scan assembly is arranged to mechanically rotate said cavity and the array positioned therein.

4. A flush-mount antenna system as in claim 1, wherein the array comprises square flat-plate type subarrays contiguously positioned in a rectangular array.

5. A flush-mount antenna system as in claim 1, wherein each individual subarray of said plurality of subarrays includes slotted waveguides in parallel side-by-side arrangement and each waveguide includes at least one row of slot-type radiating elements.

6. A flush-mount antenna system as in claim 1, wherein said slot-type radiating elements comprise crossed-slot radiating elements.

7. A flush-mount antenna system as in claim 1, wherein a length edge of the array is positioned adjacent to said axis-of-rotation.

8. An antenna system, to enable communication via satellite, comprising:

a cavity having an upper perimeter and a depth normal to said perimeter;

an array comprising a plurality of subarrays positioned in a two-dimensional arrangement having an edge section and configured to provide a beam pattern, each said subarray including at least one waveguide section having slot-type radiating elements;

said array positioned within said cavity and arranged for rotation about an axis-of-rotation adjacent to said edge section of the array to scan the beam pattern in elevation;

an elevation scan actuator to mechanically tilt said array by rotation about said axis-of-rotation without removing the array from said cavity;

a signal port; and a feed configuration to couple signals between the signal port and each subarray.

9. An antenna system as in claim 8, additionally comprising:

an azimuth scan assembly to mechanically rotate said array to scan the beam pattern in azimuth.

10. An antenna system as in claim 9, wherein the azimuth scan assembly is arranged to mechanically rotate said cavity and the array positioned therein.

11. An antenna system as in claim 8, wherein the array comprises square flat-plate type subarrays contiguously positioned in a rectangular array.

12. An antenna system as in claim 8, wherein each individual subarray of said plurality of subarrays includes slotted waveguides in parallel side-by-side arrangement and each waveguide includes at least one row of slot type radiating elements.

13. An antenna system as in claim 8, wherein said slot-type radiating elements comprise crossed-slot radiating elements.

14. An antenna system as in claim 8, wherein the upper perimeter includes a linear side portion and said axis-of-rotation is adjacent and parallel to said linear side portion and said array edge section.

15. An antenna system, to enable communication via satellite, comprising:

a cavity having an upper perimeter including a linear side portion and a depth normal to said perimeter;

an array comprising a plurality of radiating elements positioned in a two-dimensional arrangement and configured to provide a beam pattern, the array including a linear edge section;

said array positioned within said cavity and arranged for rotation about an axis-of-rotation to scan the beam pattern in elevation, said axis-of-rotation adjacent and parallel to said side portion and said edge section;

an elevation scan actuator to mechanically tilt said array by rotation about said axis-of-rotation without removing the array from said cavity;

a signal port; and a feed configuration to couple signals between the signal port and said array.

16. An antenna system as in claim 15, additionally comprising:

an azimuth scan assembly to mechanically rotate said array to scan the beam pattern in azimuth.

17. An antenna system as in claim 16, wherein the azimuth scan assembly is arranged to mechanically rotate said cavity and the array positioned therein.

18. An antenna system as in claim 15, wherein the array comprises square flat-plate type subarrays contiguously positioned in a rectangular array.

19. An antenna system as in claim 18, wherein each individual subarray includes slotted waveguides in parallel side-by-side arrangement and each waveguide includes at least one row of slot type radiating elements.

20. An antenna system as in claim 19, wherein said slot-type radiating elements comprise crossed-slot radiating elements.

* * * * *